US007811509B2

(12) United States Patent
Vild et al.

(10) Patent No.: US 7,811,509 B2
(45) Date of Patent: Oct. 12, 2010

(54) MATERIAL SUBMERGENCE SYSTEM

(75) Inventors: Chris T. Vild, Cleveland Heights, OH (US); Richard Henderson, Solon, OH (US); Richard C. Chandler, Solon, OH (US)

(73) Assignee: Pyrotek, Inc., Spokane, WA (US)

( * ) Notice: Subject to any disclaimer, the term of this patent is extended or adjusted under 35 U.S.C. 154(b) by 168 days.

(21) Appl. No.: 11/998,943

(22) Filed: Dec. 3, 2007

(65) Prior Publication Data

US 2008/0206473 A1 Aug. 28, 2008

(51) Int. Cl.
*B05D 1/18* (2006.01)

(52) U.S. Cl. ..... 266/44; 266/216

(58) Field of Classification Search ..... 266/216, 266/233, 236, 44
See application file for complete search history.

(56) References Cited

U.S. PATENT DOCUMENTS 3,245,899 A * 4/1966 Brown, Jr. et al. ..... 204/245
5,439,563 A * 8/1995 Sivilotti ..... 205/404
2006/0125159 A1 * 6/2006 Vild et al. ..... 266/216

* cited by examiner

*Primary Examiner*—Scott Kastler
(74) *Attorney, Agent, or Firm*—Fay Sharpe LLP

(57) ABSTRACT

A molten metal submergence device includes a submergence chamber, an inlet pipe, and a vortex breaker. The submergence chamber is defined by a side wall and includes an inlet in communication with an associated molten metal bath and an outlet in communication with the associated molten metal bath. The inlet is positioned in relation to the side wall such that material passing through the inlet is introduced at least substantially tangentially to the side wall. The inlet pipe is in communication with the inlet of the submergence chamber. The inlet pipe is configured to depend from a wall of the submergence chamber within the confines of the side wall. The vortex breaker is disposed in the submergence chamber between the inlet and the outlet.

14 Claims, 4 Drawing Sheets

FIG. 1
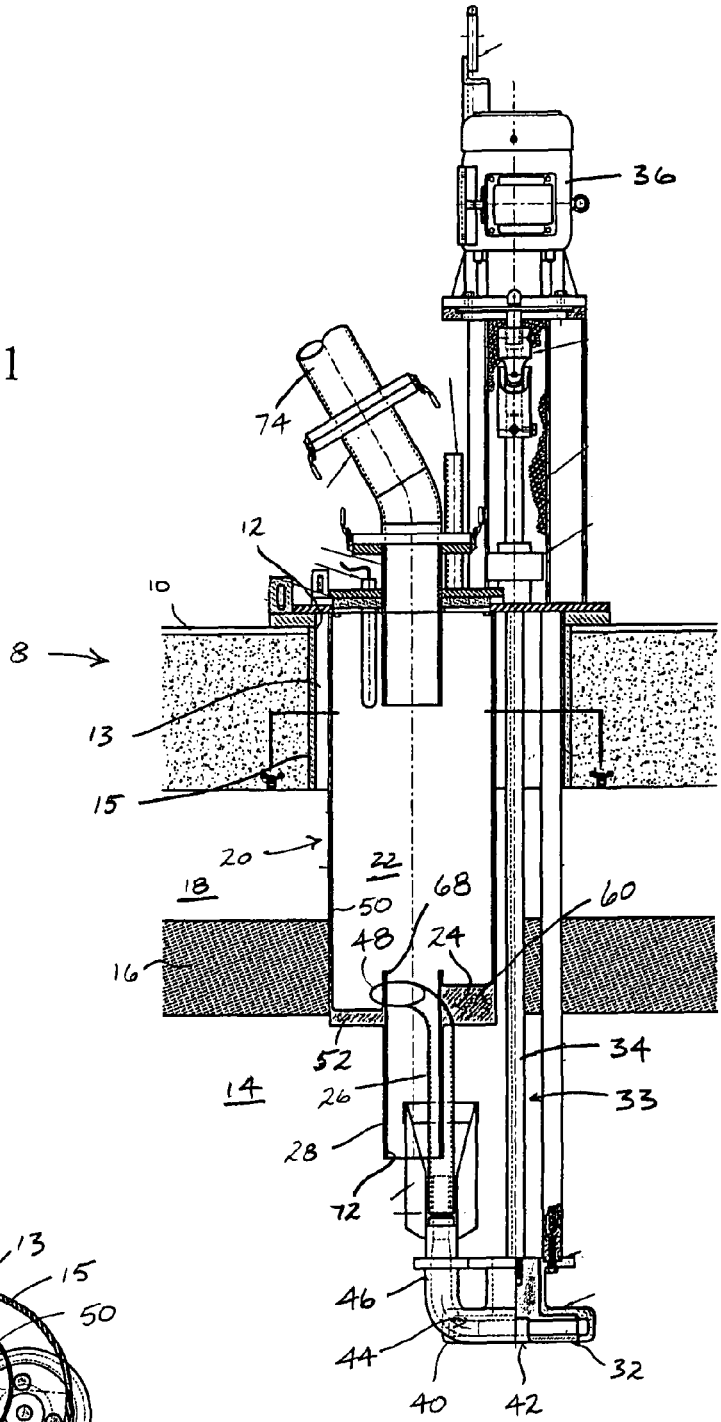
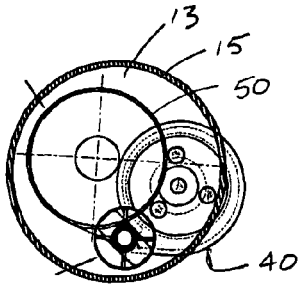
FIG. 2

MATERIAL SUBMERGENCE SYSTEM

This application claims the priority benefit of U.S. application Ser. No. 10/723,504, now abandoned, filed Nov. 26, 2003, which claims the priority benefit of U.S. application Ser. No. 60/429,502, filed Nov. 27, 2002, the disclosure of which is incorporated herein by reference.

BACKGROUND OF THE INVENTION

The present invention is directed to a submergence system. The invention can be employed in processes and apparatus for producing molten materials by electrolysis of their salts where the metal is lighter than the electrolyte. The invention can also be employed in processes and apparatus for producing molten materials not relying on electrolysis systems, one non-limiting example being a scrap submergence system.

Electrolytic cells for producing magnesium metal from $MgCl_2$ are well known and widely employed in present-day commercial practice. Typically, in such a cell, the $MgCl_2$ is dissolved in a molten salt electrolyte comprising a mixture of alkali metal and alkaline earth metal chlorides. Magnesium metal deposits in molten state on cell cathode(s) and chlorine gas is generated at anode(s) within a cell chamber; since both the metal and the gas are lighter than the electrolyte, both migrate upwardly. The magnesium metal is transported to a locality outside the cell chamber for collection and periodic removal, while the chlorine gas is separately collected and withdrawn above the cell chamber.

As more specifically described in U.S. Pat. No. 5,439,563 ("the '563 patent"), which is incorporated herein by reference, an electrolytic cell can include a main chamber that holds molten salt electrolyte containing dissolved $MgCl_2$. As free electrons are introduced to the molten salt electrolyte, which includes the $MgCl_2$, the dissolved $MgCl_2$ reacts in the electrolytic cell to form molten magnesium and chlorine gas. Accordingly, to produce more molten magnesium the $MgCl_2$ must be replenished. A known way of replenishing the $MgCl_2$ is by introducing $MgCl_2$ particulates through a conduit that discharges the particulates into the molten salt electrolyte bath. As shown in the '563 patent, a vertical screw feeder can deliver the particulate $MgCl_2$ through a conduit to the molten salt electrolyte bath that is below the molten magnesium layer. In another embodiment disclosed in the '563 patent, the particulate $MgCl_2$ can be delivered onto a free surface of the molten salt electrolyte bath.

Each of these systems for replenishing the particulate $MgCl_2$ must confront the problem of submerging the particulate $MgCl_2$ into the molten salt electrolyte. The particulate $MgCl_2$ is difficult to submerge into the molten salt electrolyte because of its inherent wetting characteristics as a function of surface tension. Accordingly, it is desirable to provide an apparatus, system and method to promote the submersion of the $MgCl_2$ particulates into the molten salt electrolyte to replenish the system for producing molten magnesium. Furthermore, it is desirable to provide an apparatus, system and method to promote the submersion of materials, in general, into a molten liquid to replenish a system that produces molten liquid, or the like.

SUMMARY OF THE INVENTION

A molten metal submergence device includes a submergence chamber, an inlet pipe, and a vortex breaker. The submergence chamber is defined by a side wall and includes an inlet in communication with an associated molten metal bath and an outlet in communication with the associated molten metal bath. The inlet is positioned in relation to the side wall such that material passing through the inlet is introduced at least substantially tangentially to the side wall. The inlet pipe is in communication with the inlet of the submergence chamber. The inlet pipe is configured to depend from a wall of the submergence chamber within the confines of the side wall. The vortex breaker is disposed in the submergence chamber between the inlet and the outlet.

According to the present invention, a new method for submerging metal salts is provided. The method includes providing a chamber that is separate from while in communication with a molten salt electrolyte bath. The method also includes pumping molten salt electrolyte from the molten salt electrolyte bath through an inlet of the chamber. The method further includes creating a vortex of molten salt electrolyte inside the chamber. The method also includes introducing solid metal salt into the chamber to create a molten salt electrolyte and solid metal salt mixture. Typically, the solid metal salt will be in particulate form, such as a powder with an average particulate size of about 80 microns. The method further includes flushing the mixture inside the chamber through an outlet back into the molten salt electrolyte bath.

According to the present invention, a new system for submerging metal is provided. The system includes a closed top cell holding molten salt electrolyte, a molten metal layer floating on the molten salt electrolyte and a gas space interposed between the molten metal and a top of the well. A chamber is disposed inside the well. The chamber includes at least one side wall and a base wall. An inlet is disposed on one of the walls of the chamber. The inlet communicates with an inlet pipe. The inlet pipe communicates with a pump disposed in the cell. The pump delivers molten salt electrolyte to the chamber. A vortex breaker is disposed in the chamber. An outlet is disposed on one of the walls of the chamber below the inlet, which may include the bottom wall. The outlet communicates with an outlet pipe. The outlet pipe delivers the molten salt electrolyte to the cell in the molten salt electrolyte bath below the molten metal layer.

The advantages and benefits of the present invention will become apparent to those of ordinary skill in the art upon reading and understanding the following detailed description of the preferred embodiments.

BRIEF DESCRIPTION OF THE DRAWINGS

The invention can take physical form in certain parts and arrangements of parts, preferred embodiments of which will be described in detail in this specification and illustrated in the accompanying drawings. Since the drawings only disclose preferred embodiments, the invention must not be limited to the depictions shown herein.

FIG. 1 is a schematic view of a portion of an electrolytic cell including the metal submerging apparatus of the present invention.

FIG. 2 is top plan view of FIG. 1 taken at line B-B.

DETAILED DESCRIPTION OF THE PREFERRED EMBODIMENTS

Figure 3:
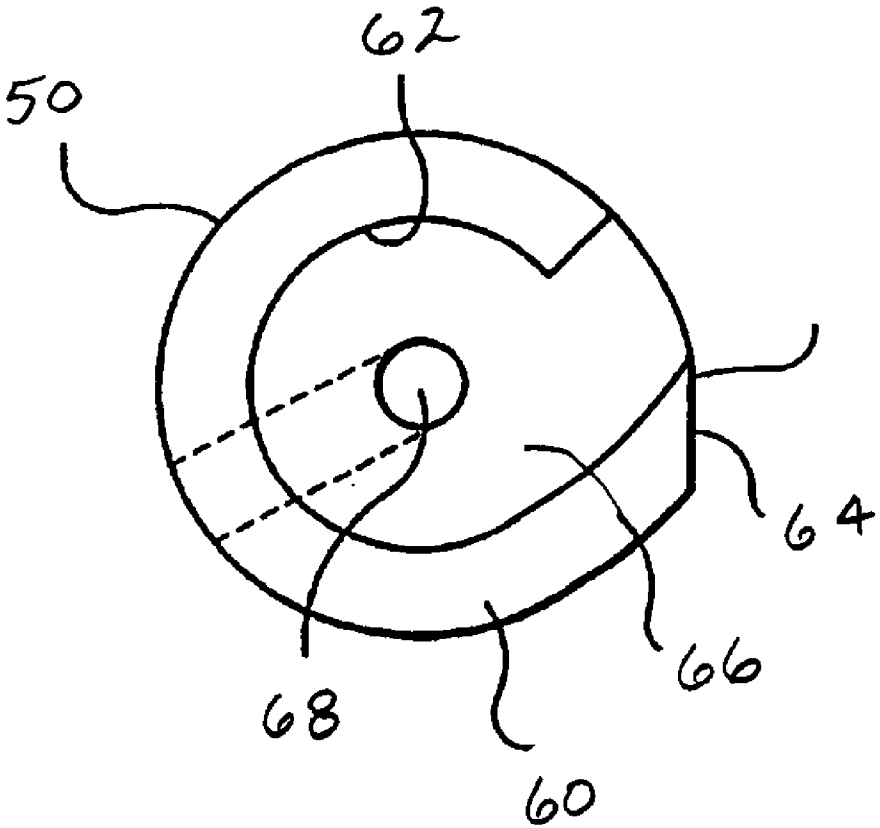
FIG. 3 is a top plan view of FIG. 1 taken at line C-C.

It is to be understood that the specific devices, processes and systems illustrated in the attached drawings, and described in the following specification are simply exemplary embodiments of the inventive concepts. Even though the apparatus, method and system will be described in connection with submerging particulate metal salts into a molten salt electrolyte, it is understood that the invention can be used to submerge other materials, including, but not limited to, scrap, dust, and other solids, and even other liquids into a bath not limited to molten salt electrolytes. Hence, specific examples and characteristics relating to the embodiments disclosed herein are not to be considered as limiting.

Referring to FIG. 1, a portion of a cell, which can comprise a portion of an electrolytic cell, is generally designated at 8. The cell 8 includes side walls (not shown), and a base wall (not shown). The cell also includes a top 10 that covers and optionally seals the cell when the cell is in operation. The side walls, the base wall and the top can include a refractory lining, which is well known in the art, and need not be described in greater detail. The top 10 includes an opening 12 to a charging well 13 defined by wall 15, through which a metal submerging apparatus 20 is received. Since this invention is applicable as a component for existing electrolytic cells, the metal submerging apparatus and all of its components are sized to be received inside the charging well 13 through the top opening 12.

The cell 8 holds a molten salt electrolyte bath 14, a molten metal layer 16, and a gas space 18. The molten salt electrolyte bath 14, the molten layer 16, and the gas space 18 are well known in the art and described in U.S. Pat. No. 5,439,563. As a result of an electrolytic process that takes place in the electrolytic cell, the molten metal layer 16 is formed on top of the molten salt electrolyte bath 14 and, in the case of magnesium formed from magnesium chloride, chlorine is also formed. The chlorine is removed from the magnesium metal production system in a process that is also well known in the art.

In the case of producing magnesium metal from $MgCl_2$, particulate $MgCl_2$ is introduced into the molten salt electrolyte bath 16. Through the electrolytic process, the $MgCl_2$ is converted into molten magnesium and chlorine gas. The molten magnesium 16 is then removed. Accordingly, either intermittently or continuously, more particulate $MgCl_2$ must be introduced into the system to replenish the $MgCl_2$ that has been converted into molten magnesium and chlorine. The present invention is capable of either, but is particularly beneficial as a continuous process. The metal submerging apparatus 20 is disposed inside the cell 8 to facilitate submergence of the particulate $MgCl_2$ into the molten salt electrolyte bath 14.

The metal submerging apparatus 20 generally includes a submergence chamber 22 where a vortex flow of molten salt electrolyte is created and a vortex breaker 24 to direct the vortex flow out of the chamber. In addition to the creation of a vortex, a general turbulent flow of molten salt electrolyte can also be created inside of the chamber to facilitate submersion of the particulate $MgCl_2$. An inlet pipe 26 delivers molten salt electrolyte from the molten salt electrolyte bath 14 to the chamber 22. The molten salt electrolyte is delivered to the chamber such that it intersects the chamber in a tangential direction, so that a vortex is formed. The vortex breaker 24 disrupts a vortex of the molten salt electrolyte that has been produced in the chamber 22 to direct the vortex flow of the molten salt electrolyte out of the chamber. Particulate $MgCl_2$ is delivered to the chamber 22. The order of the creation of the vortex and the delivery of the particulate is not critical. The vortex that is formed in the chamber facilitates the submergence of the particulate $MgCl_2$. The molten salt electrolyte and $MgCl_2$ mixture is then delivered back to the molten salt electrolyte bath via a discharge pipe 28.

The system will now be described as molten salt electrolyte flows through the submergence system. An impeller 32 of a pump 33 is disposed in the molten salt electrolyte bath 14. The impeller 32 is mounted to a shaft 34. The shaft 34 is connected to a motor 36 that rotates the shaft, which rotates the impeller 32. The impeller 32 is housed in a pump housing 40 that includes an inlet 42 to draw molten salt electrolyte into the pump housing. The housing 40 also includes an outlet 44 in communication with a discharge pipe 46. The discharge pipe 46 communicates with the inlet pipe 24. The inlet pipe 24 communicates with a chamber inlet 48 on a side wall 50 of the chamber 22. Advantageously, the pump 33 and submerging apparatus 20 are both fitted within the charging well 13.

The chamber inlet 48 is positioned so that molten salt electrolyte that enters the chamber enters at a generally horizontal angle. The horizontal orientation of the inlet 48 promotes formation of the molten salt electrolyte vortex inside of the chamber. The inlet 48 of the chamber is shown on a side wall 50 of the chamber; however, the inlet could also be located on a base wall 52 of the chamber. The inlet 48 could also straddle both the side wall 50 and the base wall 52 of the chamber 22. The terms side wall and base wall are used simply to describe the figures, in that both the side wall and the base wall in combination can form the side wall of the metal submerging apparatus. As more clearly shown in FIG. 2, the side wall 50 is generally circular in cross-section. The circular orientation of the side wall 50 further facilitates the creation of the molten salt electrolyte vortex inside of the chamber 22.

The vortex breaker 24 is situated near the chamber inlet 48. In one embodiment of the invention, the vortex breaker 24 comprises a ramp 60, similar to the ramp disclosed in U.S. Pat. No. 6,217,823, which is incorporated herein by reference. As seen in FIG. 3, the ramp 60 includes an inner edge 62 and a leading edge 64 positioned adjacent the inlet 48. Molten salt electrolyte flows up the ramp 60 within the chamber 22 and spills over the inner edge 62 into a cavity 66 and exits through an outlet 68 positioned below the inlet 48. While it is beneficial that the ramp 60 be sloped, this does not need to be achieved by a constant incline. For example, the ramp 60 can be sloped over a first portion, and be horizontal over a final portion. Similarly, the ramp need not encircle the entire side wall 50. Accordingly, the invention is intended to encompass all versions of a sloped ramp.

In an alternate embodiment, the vortex breaker can take form in a blade 80 (FIG. 4) positioned on the side wall 50. The blade can be any shape including the device disclosed in U.S. Pat. No. 6,036,745, which is incorporated herein by reference. In this embodiment, the molten salt electrolyte enters the chamber 22 via the inlet 48 in a horizontal direction. The horizontally moving molten salt electrolyte contacts the blade resulting in a break in the vortex causing the molten salt electrolyte to move downward an out the outlet 68.

In an alternate embodiment, the vortex breaker can comprise a system including a second inlet (not shown) that delivers a second molten salt electrolyte stream positioned below the horizontal chamber inlet 48 that delivers a first molten salt electrolyte stream. This system for creating a vortex is similar to that described in U.S. Pat. No. 4,286,985, incorporated herein by reference. In this embodiment, the horizontal chamber inlet 48 intersects the chamber 22 in a tangential manner while the second inlet, which also delivers molten salt electrolyte, intersects the side of the chamber 22 in a substantially radial manner. Accordingly, the second molten salt electrolyte stream breaks the vortex flow of the first molten salt electrolyte stream directing both the molten streams out of the outlet 68 of the chamber 22.

In addition to the vortex systems described above, the vortex of the molten salt electrolyte can be achieved using any know apparatus, system or method that will result in a vortex. As stated above, the creation of a vortex facilitates the submergence of the particulate $MgCl_2$ into the molten salt electrolyte. Additionally, the vortex can be broken to direct the molten salt electrolyte stream out of the chamber in any known manner.

Referring back to the flow of the molten salt electrolyte through the metal submergence system, the molten salt electrolyte exits the chamber via the outlet 68. The outlet 68 communicates with the discharge pipe 28. The discharge pipe 28 includes an outlet 72 disposed in the molten salt electrolyte bath 14 below the molten metal 16. The molten salt electrolyte is discharged below the molten metal layer 16 so as not to disturb the molten metal layer. Accordingly, the length of the discharge pipe 28 can be modified as a function of the depth of the molten metal layer 16.

Particulate $MgCl_2$ is fed into the metal submergence apparatus 20 via a cell feed pipe 74. The cell feed pipe 74 can deliver the particulate $MgCl_2$ via a screw feeder operator or a spinning distributor, as disclosed in U.S. Pat. No. 5,439,563. The cell feed pipe can also deliver the particulate $MgCl_2$ to a plurality of sprayers that will inject the particulate $MgCl_2$ into the chamber. In addition to those, the cell feed pipe 74 can deliver the particulate $MgCl_2$ via any distribution system that can deliver the particulate matter to the chamber 22. Accordingly, the particulate matter is delivered to the chamber 22 where it submerges into the molten salt electrolyte flowing in the chamber resulting in a mixture of particulate $MgCl_2$ and molten salt electrolyte.

As has been stated above, since this invention is applicable as a component for an existing electrolytic cell, the metal submerging apparatus 20, and all of its components, can be designed to be received inside the opening 12 in the top 10 of the cell 8. In some known apparatus, this opening 12 can be smaller than 30 inches. Accordingly, the chamber 22 and the pump must be sized such that a vortex can be created in this limited space. Furthermore, the impeller 32 is positioned near the chamber, when measured in a direction parallel to the top 10 of the cell, due to the limited space that the metal submerging apparatus 20 is allowed to occupy when retrofitting such cells.

Figure 4:
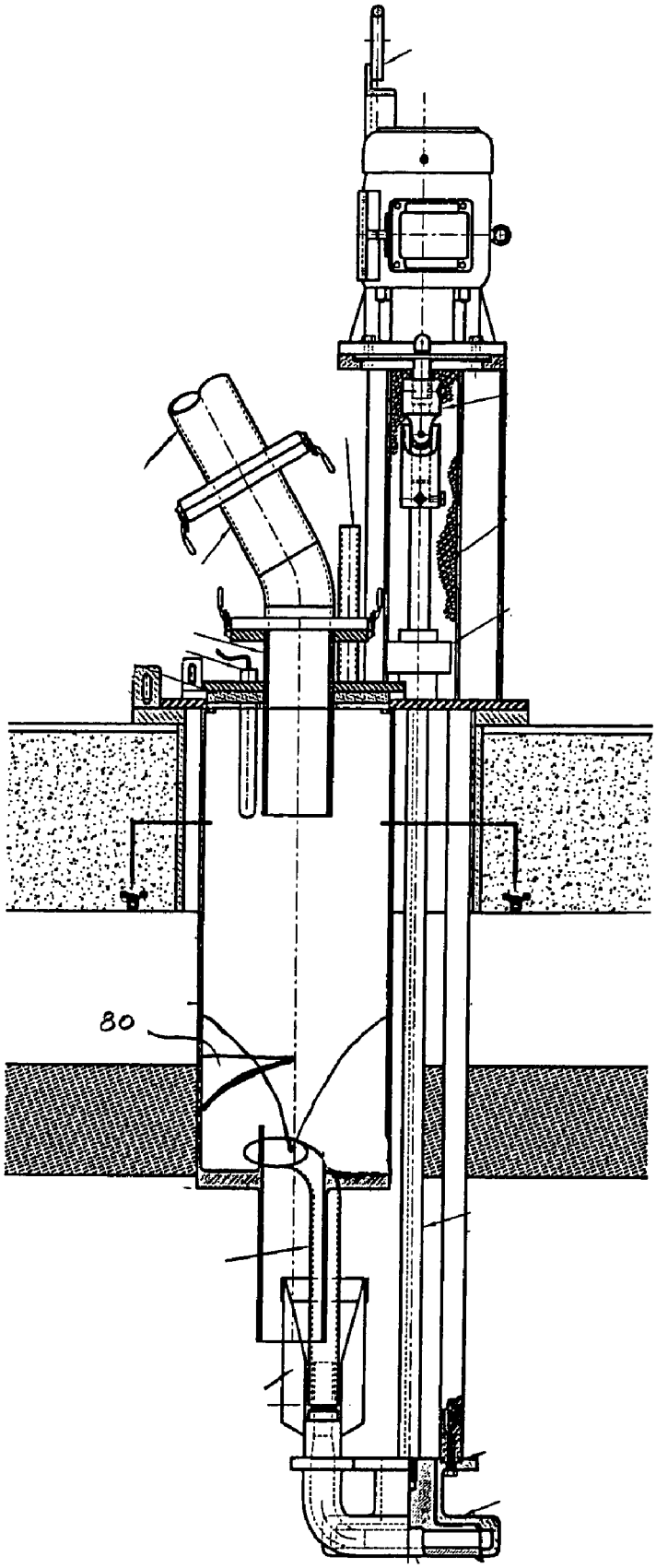
FIG. 4 is the portion of the electrolytic cell including the metal submerging apparatus of FIG. 1 showing an example of a vortex in a chamber of the metal submerging apparatus and an alternative vortex breaker.

With a vertical discharge pipe 26, the nadir of the vortex can be positioned inside of the discharge pipe 26 (FIG. 4). This can be achieved through proper dimensioning of the chamber 22 in combination with adjusting the rate at which molten salt electrolyte is fed to the chamber 22 by the rotating impeller 32. Accordingly, the metal submerging apparatus 20 can be retrofitted into an existing electrolytic cell having a short height and the metal submergence apparatus can still fit into this limited space. Moreover, the available height for the chamber 22 does not limit the submergence apparatus 20 because the rate of rotation of the vortex, which helps determine the height the molten salt electrolyte will reach on the chamber wall 50, can be controlled by the feed rate from the pump. However, it has generally been shown that a relatively steep inclined vortex is beneficial in achieving efficient particulate submergence.

The following examples are provided to facilitate the explanation of the invention but are not intended to limit the invention to the specific embodiments disclosed.

EXAMPLES

Water modeling tests of the present system were conducted to evaluate the submergence performance. It is recognized that the most difficult part of the $MgCl_2$ melting process is particle contact with the molten metal salt. Therefore, particle contact would represent the rate controlling effect. Contact angle, as a function of surface tension, was used to judge wetting characteristics of the feed stock.

In the water modeling tests, polypropylene powder was used as the feed stock because of its high surface tension with water. Furthermore, polypropylene proved a difficult option as it was not melted or dissolved by the water medium. Accordingly, choosing polypropylene powder as a feed stock in the water model represented a worse case scenario as compared to the submergence of $MgCl_2$ in an electrolytic system.

In the test, the polypropylene powder had a diameter of 80 microns, which is similar to the particulate size of $MgCl_2$ feed stock used in present electrolytic systems. Buoyancy effects were also held constant for the water modeling tests. The ratio of specific gravity of the liquid to bulk density of the feed stock was approximately 2:1, which is approximates the ratio in an $MgCl_2$ system. The feed rate was demonstrated based on a constant volume calculation based on bulk density.

A summary of the properties of the materials used in the water modeling tests versus the equivalent properties in an actual $MgCl_2$ electrolytic system are provided below.

| | $MgCl_2$ | Polypropylene/Water |
|---|---|---|
| Bulk Density of the feed stock | 900 g/l | 450 g/l |
| Specific Gravity of the liquid | 1700 g/l | 1000 g/l |
| Contact Angle of the feed stock | >90° | 105° |
| Particle Size of the feed stock | 80 microns | 80 microns |

The design focused on maximizing the powder to liquid contact time while ensuring a high feed rate. The submergence apparatus used a Metaullics® D13 pump in conjunction with a 13" ID chamber. The tests measure maximum wetting and submergence rate of the polypropylene powder at various pump speeds. Discharge diameter was varied to maximize the submergence and wetting rate. The results are plotted in the table at FIG. 5. Note that the feed rates in actual kg/hr of polypropylene submerged is about half the amount of $MgCl_2$ that could be submerged using the submergence apparatus due to the difference in bulk density between $MgCl_2$ and polypropylene.

Figure 5:
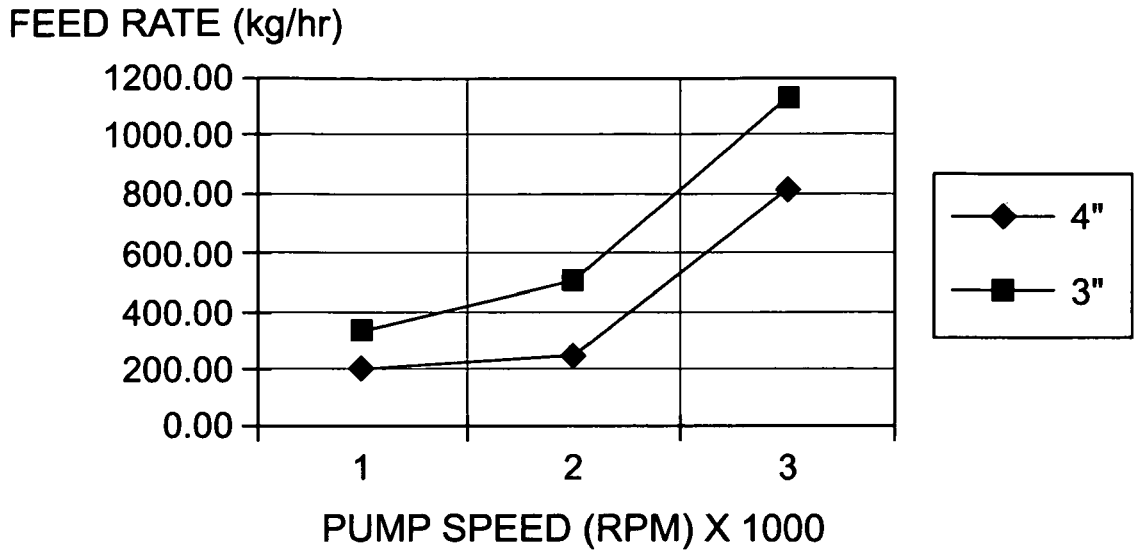
FIG. 5 is a table of test results from water modeling testing showing feed rate of polypropylene as a function of pump speed in RPM.

The points for FIG. 5 are as follows:

| 4" Outlet | | | 5" Outlet | | |
|---|---|---|---|---|---|
| RPM | sec/5 kg | kg/hr | RPM | sec/5 kg | kg/hr |
| 1200 | 88 | 204.55 | 1200 | 54 | 333.33 |
| 1400 | 74 | 243.24 | 1400 | 36 | 500.00 |
| 1800 | 22 | 818.88 | 1800 | 16 | 1125.00 |

The invention has been described with reference to the preferred embodiments. Obviously, modifications and alterations will occur to others upon reading and understanding the preceding detailed description. It is intended that the invention be construed as including all such modifications and alterations.

What is claimed is:

1. A method for submerging metal salts in an electrolytic cell, the method comprising:

providing a first chamber containing an upper molten metal layer and a lower molten salt electrolyte bath;

providing a second chamber, said second chamber penetrating the upper molten metal layer and in fluid communication with the molten salt electrolyte bath;

providing a molten metal pump including a housing containing an impeller, said impeller being rotated by a shaft extending outside said electrolytic cell;

said pump residing outside said second chamber and forcing molten salt electrolyte from the molten salt electrolyte bath into a lower portion of the second chamber, wherein the molten salt electrolyte provided by said pump creates a vortex in the chamber;

introducing a solid metal salt into an upper portion of the second chamber to create a mixture; and flushing the mixture in the second chamber into the molten salt electrolyte bath through an exit in a base of said second chamber.

2. The method of claim 1, wherein the step of flushing the mixture in the chamber back into the molten salt electrolyte bath includes breaking the vortex.

3. The method of claim 1, wherein the step of flushing the mixture in the chamber back into the molten salt electrolyte bath includes discharging the mixture from the chamber below a layer of substantially pure molten metal.

4. The method of claim 1, wherein the molten salt electrolyte in the introducing molten salt electrolyte step comprises magnesium and chlorine.

5. The method of claim 1, wherein the solid metal salt in the introducing the solid metal salt into the chamber step comprises powdered magnesium chloride.

6. The method of claim 1, wherein the introducing molten salt electrolyte from the molten salt electrolyte bath step includes pumping molten salt electrolyte disposed below a layer of substantially pure molten metal into the chamber.

7. The method of claim 2, wherein one of a ramp, a blade and a second substantially radial second chamber inlet performs the breaking the vortex step.

8. The method of claim 1 wherein said molten salt electrolyte is introduced by the molten metal pump in a direction tangential to a wall forming the second chamber.

9. The method of claim 7 wherein said vortex breaking step is achieved via a ramp.

10. The metal of claim 7 wherein said vortex breaking step is achieved via a blade.

11. The method of claim 2 wherein said molten salt electrolyte from the molten salt electrolyte bath enters the second chamber from an inlet distinct from the exit through which said mixture departs said second chamber.

12. The method of claim 2 wherein said second chamber is generally circular in cross-section.

13. The method of claim 9 wherein said ramp is comprised of a substantially constant incline.

14. The method of claim 2 wherein said exit includes a discharge pipe of sufficient length to penetrate said molten metal layer and discharge said mixture into said molten salt electrolyte bath.

* * * * *